US005967690A

United States Patent [19]

Tibbetts

[11] Patent Number: 5,967,690

[45] Date of Patent: Oct. 19, 1999

[54] LOOSE-LEAF BINDER

[75] Inventor: Paul R. Tibbetts, Palmer, Mass.

[73] Assignee: Specialty Loose Leaf, Inc., Holyoke, Mass.

[21] Appl. No.: 08/832,579

[22] Filed: Apr. 2, 1997

[51] Int. Cl.[6] ..... B42F 13/00

[52] U.S. Cl. ..... 402/73; 281/29; 281/34; 402/70; 402/75; 402/80 R

[58] Field of Search ..... 402/31, 70, 73, 402/75, 80 R; 281/29, 34, 36, 37

[56] References Cited

U.S. PATENT DOCUMENTS 3,606,557 9/1971 Schade ..... 402/31
3,717,416 2/1973 Schade ..... 402/31
3,718,402 2/1973 Schade ..... 402/31
5,718,530 2/1998 Tibbetts ..... 402/73

*Primary Examiner*—Willmon Fridie, Jr.
*Assistant Examiner*—Monica Smith
*Attorney, Agent, or Firm*—Robert A. Seemann

[57] ABSTRACT

A ring capture mechanism of a loose-leaf binder includes a first plate having a U-shaped slot of continuous circumference designed to receive a ring of the binder through the slot within the circumference. The first plate moves across a second plate having a straight slot of continuous circumference designed to receive the ring of the binder, and locks the arms of a ring contained in both slots in the legs of the U-shaped slot.

14 Claims, 5 Drawing Sheets

LOOSE-LEAF BINDER

BACKGROUND OF THE INVENTION

1. Field of the Invention

The invention pertains to a binder which releasably engages an aperture in a sheet, more particularly to a ring binder in which the ring may be releasably latched to a panel of the binder.

2. Description of the Prior Art

A prior art loose-leaf ring binder which releasably latches a ring to a panel of the binder is described in FIGS. 1–4 of the present specification wherein binder 30 cover 31 folds on hinges 34 so that ends 46 of rings 38 can be moved to stamped metal plate 52 of hook bar 44. Hook bar 44 is attached by rivet 36 through slot 37 to panel 32 of binder 30 for limited longitudinal sliding movement along panel 32.

Hooks 40 of hook bar 44 are slipped over ends 46 by moving hook bar 44 in direction 48. Movement of hook bar 44 is accomplished by pushing on tab 50.

Rings 38 are held under hooks 40 of capture mechanism 42 and between upturned shoulder walls 54 and 56 of plate 52 as indicated in FIGS. 3 & 4.

Arms 64 and 66 pivot at conventional pivot mechanism 62 and swing 63 open and closed. They may be opened by operating lever 53.

Arms 64 and 66 hold pages 60 which are moved to arm 66 in the region 58 between the pivot mechanism end of the hooked arm and shoulder wall 56 when rings 38 are locked into capture mechanism 42. Wall 56 is cut away in FIG. 4 for clarity.

U.S. Pat. No. 3,606,557 patented Sep. 20, 1971 by F. S. Schade describes and claims a loose-leaf binder having pivoted arm rings like the one described above, in which the ring capture mechanism for the loose-leaf binder comprises an elongated channel plate member, flanged in a U-shape, fixedly attached to the binder cover with the planar back of the U toward a panel of the binder cover.

Between the elongated channel member and the panel is a locking plate member having a planar portion that is wider than the U-shaped channel plate member. The locking plate member is longitudinally movable over a limited distance, and has ring engaging fingers which extend through longitudinal slots in the elongated channel member and are upwardly offset from the plane of the plates and movable with the locking plate member to releasably lock the ring halves to the binder panel.

The flanged side walls of the stationary plate have opposed notch portions which seat the loose-leaf binder rings spaced from the ends of the ring.

Further, the locking plate is flanged in a U-shape upturned from the panel, so that the flanged side walls on opposite sides of the locking plate slide against the outer surfaces of the opposed halves of the loose-leaf binder rings when the closed rings are held by the fingers.

In the ring binder described and claimed in U.S. Pat. No. 3,717,416 patented Feb. 20, 1973 by F. S. Schade, the ring capture mechanism comprises an elongated U-shaped plate member fixedly attached to a panel of the loose-leaf cover, with the planar back of the U towards the panel. The side walls of the U of the plate member have inwardly turned marginal edge sections having notches for receiving the arched corners of the arms of the rings adjacent to the ends of the rings.

An elongated releasable locking plate member having a planar central section overlies the planar central portion of the U-shaped plate member in flat planar relation and is mounted on the planar central portion for limited longitudinal movement thereon. The locking plate member has outwardly angled marginal side portions which extend in underlying relationship to the inwardly turned marginal edge sections of the stationary plate, and has ring engaging fingers offset outwardly of the plane of the planar central section and is movable to releasably hold the outer end portions of the rings against the locking plate.

In the ring binder described and claimed in U.S. Pat. No. 3,718,402, patented Feb. 27, 1973 by F. S. Schade, the ring capture mechanism comprises an elongated U-shaped plate member fixedly attached to a panel of the loose-leaf cover with the planar back of the U towards the panel. Each side wall of the U has an inverted U-shaped skirt having the inner side wall of the skirt in common with the side wall. The top connecting wall and common inner sidewall of each skirt has a notch. The notches of the opposed sidewalls of the U are oppositely located for receiving the arched corners of the arms of the rings adjacent to the ends of the rings.

An elongated releasable locking plate member having a planar central section overlies the planar central portion of the U-shaped plate member in flat planar relation and is mounted on the planar central portion for limited longitudinal movement thereon. The locking plate member has ring engaging fingers offset outwardly of the plane of the planar central section of the locking plate member and is movable to releasably hold the outer end portions of the rings against the locking plate.

SUMMARY OF THE INVENTION

It is one object of the invention to provide a ring binder capture mechanism that can be made inexpensively by stamping.

It is another object that the capture mechanism prevents opening of a ring which is captured in the mechanism.

It is another object that the capture mechanism prevents opening of a captured ring by providing unyielding lateral resistance against opening of the ring.

It is another object that the ring is fastened to the mechanism by a finger of the mechanism, without interfering with paper carrying capacity of the portion of the ring that is behind the finger.

It is another object that the ring is captured by a finger that is planar with the top of the mechanism.

Other objects and advantages will be apparent to one reading the ensuing description of the invention.

In a loose-leaf binder construction which includes a pair of arms mounted on a first body component of the loose-leaf binder and adapted for movement of front ends of the arms toward one another to form a ring for releasably engaging an aperture in a sheet of paper, and a second body component rotatably connected to the first body component, the second body component including means for releasably holding the ring by the front ends of the arms, the improvement comprising the means for releasably holding the ring by the front ends of the arms comprising:

a first plate mounted on the second body component, a first slot through the first plate, having a continuous circumference and adapted for receiving the pair of arms within the circumference of the first slot, a second plate mounted on the second body component, a second slot through the second plate, having a continuous circumference and adapted for receiving the pair of arms within the circumference of the second slot. The second slot being aligned with the first slot for receiving the pair of arms within the circumferences of the first and second slots. The first slot including a tab which extends over a portion of the second slot, configured to receive the pair of arms through the first and second slots, and extending in the plane of the first plate at the first slot.

The first plate including a first side wall having a front end and a back end, a second side wall having a front end and a back end, the first side wall and the second side wall being attached by their back ends to the first plate forming a U with the first plate, the front ends of the first and second walls being mounted toward the second body component.

One of the first and second plates sliding over the other and the second body component.

The first slot comprising a U-shape of the slot that includes a lateral base portion and a pair of extending legs of the U, each leg being configured to receive an arm of the ring.

BRIEF DESCRIPTION OF THE DRAWINGS

In order that the invention be more fully comprehended, it will now be described, by way of example, with reference to the accompanying drawings, in which:

FIG. 1 is a schematic view of a PRIOR ART loose-leaf binder.

FIG. 2 is a schematic view of the pivot mechanism of the PRIOR ART loose-leaf binder of FIG. 1.

FIG. 3 is a schematic view of the PRIOR ART loose-leaf binder of FIG. 1, with the binder rings locked in a ring capture mechanism.

FIG. 4 is a schematic section view of the PRIOR ART loose-leaf binder of FIG. 1.

DESCRIPTION OF THE PREFERRED EMBODIMENTS

Figure 1:
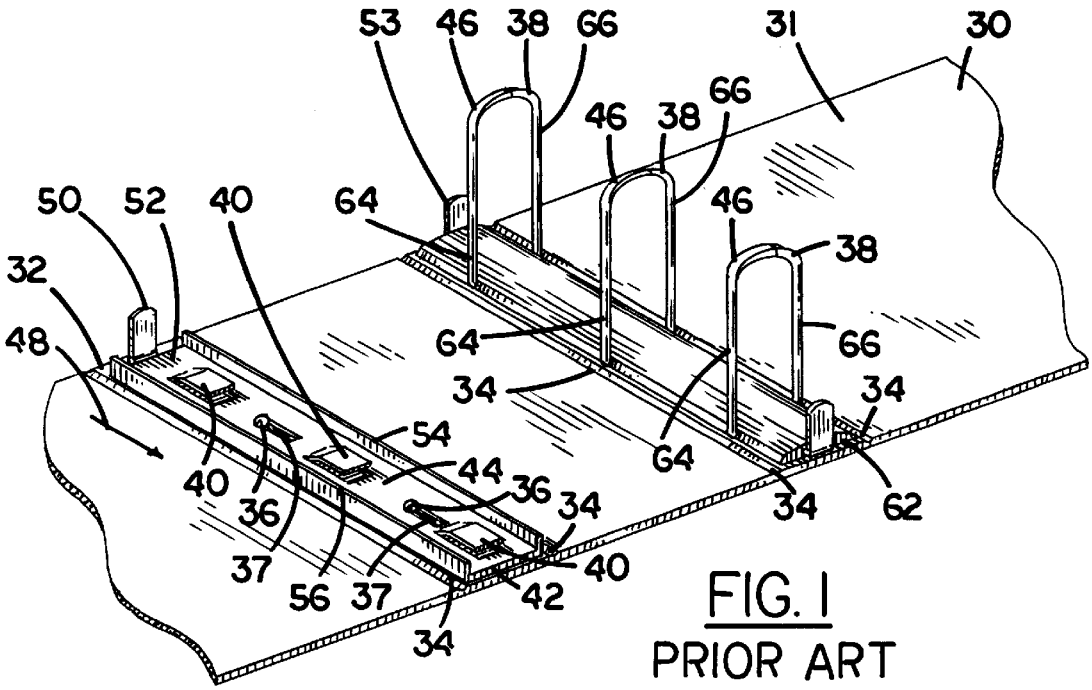
FIG. 1 PRIOR ART
FIGS. 1–4 are of Prior Art.
Figure 2:
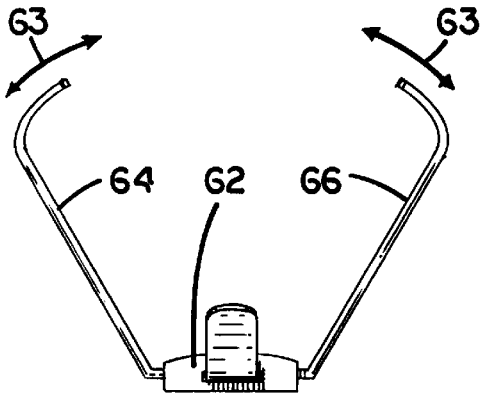
FIG. 2 PRIOR ART
Figure 3:
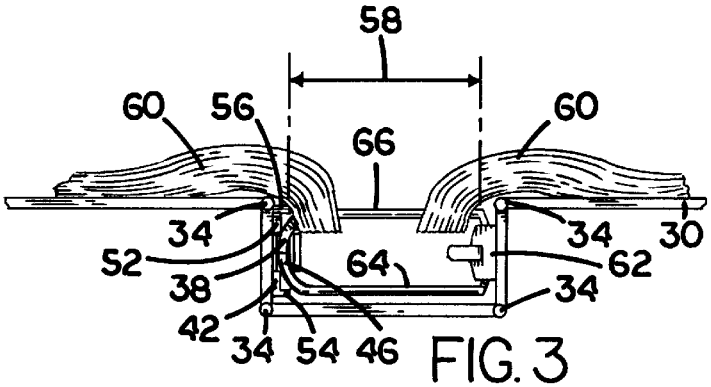
FIG. 3 PRIOR ART
Figure 4:
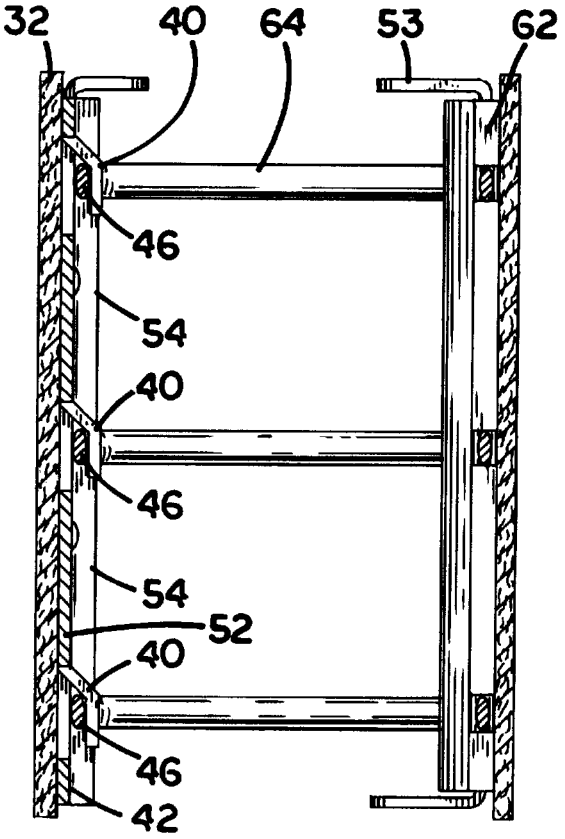
FIG. 4 PRIOR ART

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 5:
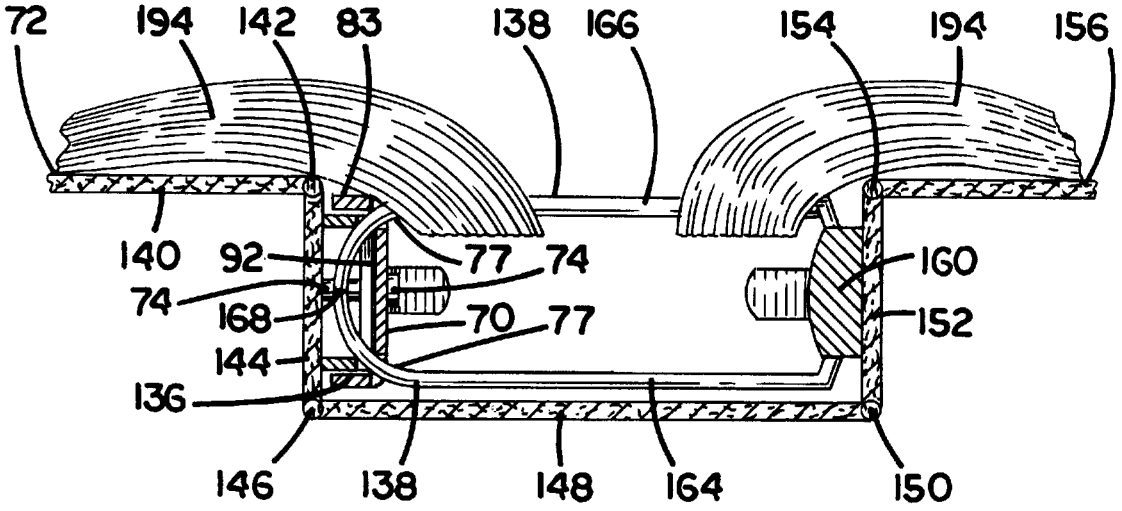
FIG. 5 is a schematic view of a loose-leaf binder having a ring capture mechanism of the present invention.
Figure 6:
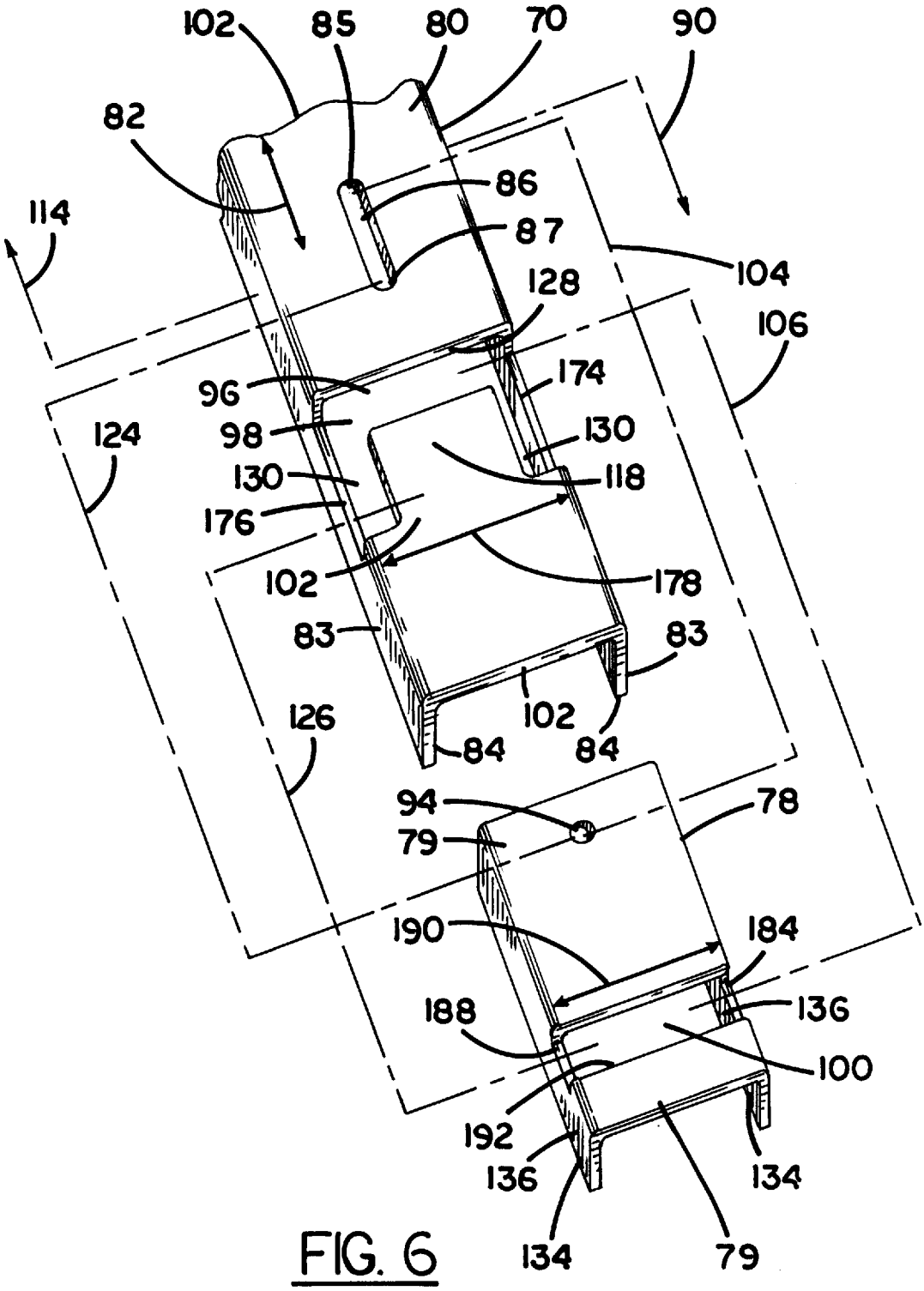
FIG. 6 is an exploded view of the ring capture mechanism of FIG. 5.

In FIG. 5, ring capture mechanism 70 is attached to panel 144 of ring binder cover 72 by a plurality of fasteners. One fastener 74 is shown.

Cover 72 includes panel 140 attached by hinge 142 to panel 144 attached by hinge 146 to panel 148 attached by hinge 150 to panel 152 attached by hinge 154 to panel 156.

Arms 164 and 166 of ring 138 extend from conventional pivot mechanism 160 and rotate together and apart at end 168 of the ring by pivoting at pivot mechanism 160.

Pivot mechanism 160 is attached to panel 152 by fastener means such as rivets, in a conventional manner. The rivets are not shown.

Referring to FIGS. 5–9, ring capture mechanism 70 includes U-shaped receiver channel 78 which has fronts 134 of side walls 136 of the U, mounted toward panel 144. Panel 79 at the back of the U is preferably planar and is spaced from and held parallel to panel 144 by side walls 136.

Fastener 74 holds receiver channel 78 fixed with respect to the binder. Fronts 134 of side walls 136 rest on face 76 of panel 144.

U-shaped lock channel 80 moves over panel 144 along a length of panel 144, on receiver channel 78. It is supported by channel 78 and spaced from panel 144 by channel 78.

Moving distance 82 is limited by the length of slot 86 engaging fastener 74. Back panel 102 of the U of channel 80 slides over panel 79 of U-shaped receiver channel 78 parallel to panel 79. It may also be in contact with panel 79. Side walls 83 of the U of channel 80 extend over and generally parallel to side walls 136 of receiver channel 78 with fronts 84 toward panel 144. Fronts 84 of sidewalls 83 preferably do not touch panel 144 so that movement of channel 80 is not impeded by contact with panel 144.

Figure 7:
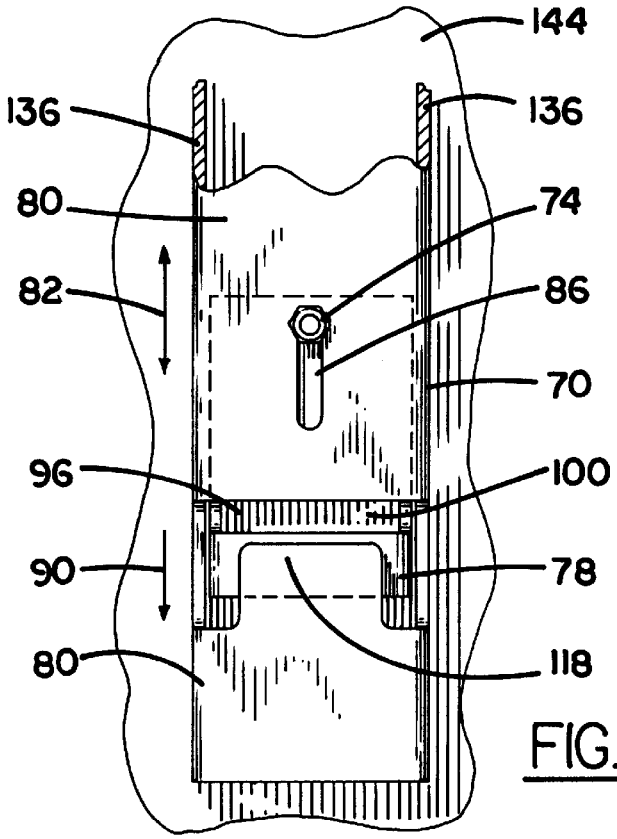
FIG. 7 is a top view of a section of the ring capture mechanism of FIG. 5 in an unlocked position.

In FIG. 7, lock channel 80 is moved as far as it will go in direction 90. Slot 86 end 85 is positioned over fastener hole 94, and lateral base portion 96 of U-shaped slot 98 is positioned over lateral receiver slot 100 through receiver channel 78 as indicated by lines 104 and 106. This leaves a wide common lateral opening of 96 plus 100, for inserting ring 138 for locking the ring in ring capture mechanism 70.

Figure 8:
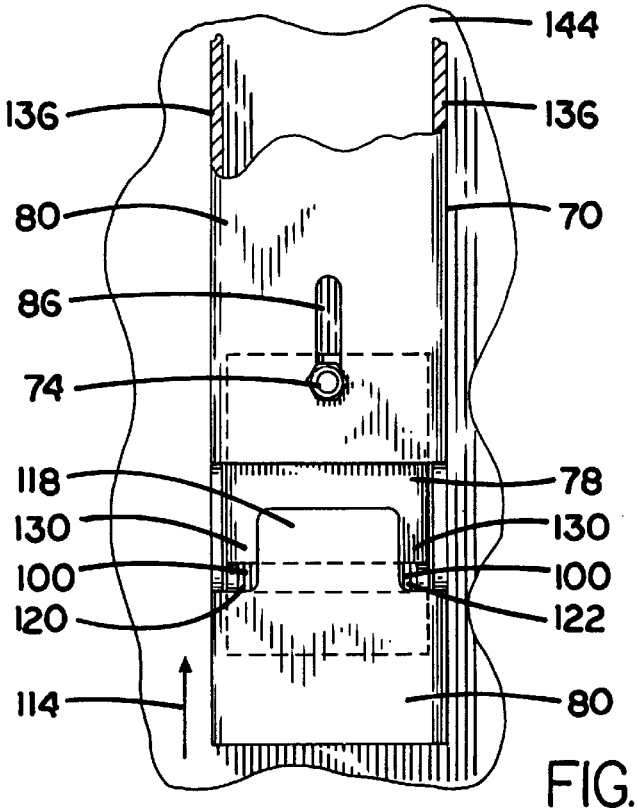
FIG. 8 is a top view of a section of the ring capture mechanism of FIG. 5 in a locked position.
Figure 9:
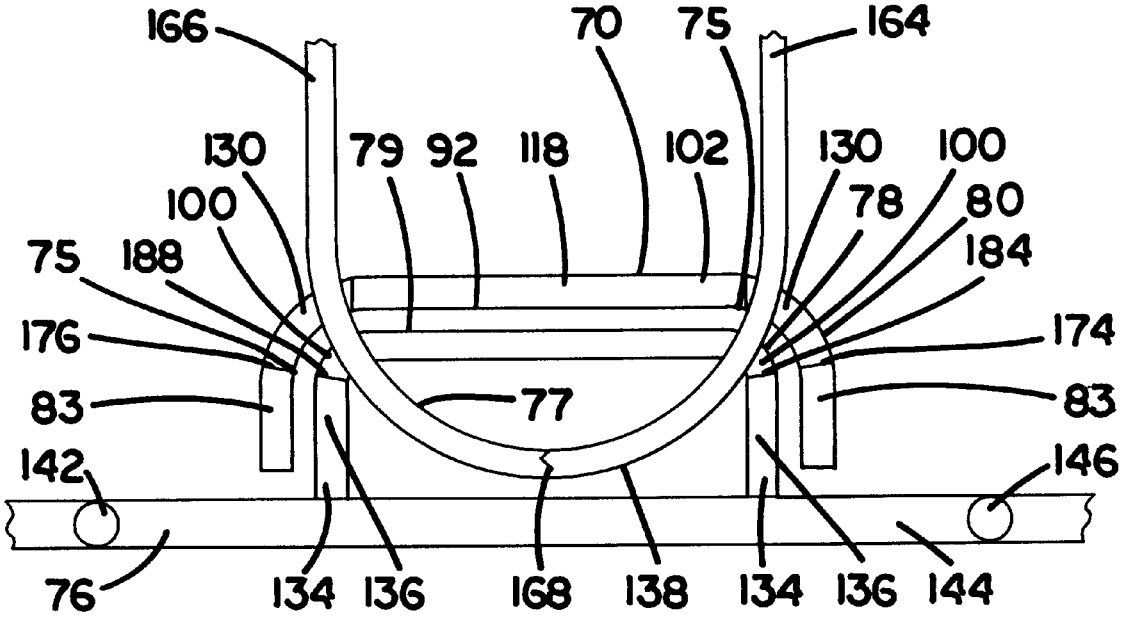
FIG. 9 is a schematic view of a portion of the ring capture mechanism of FIG. 5.

In FIG. 8, ring capture mechanism 70 is in the ring locking position. Lock channel 80 is moved as far as it will go in direction 114. Slot 86 end 87 is positioned over fastener hole 94, and lock tab 118 of U-shaped slot 98 is positioned over lateral receiver slot 100 as indicated by lines 124 and 126. This leaves two openings 120, 122, for passage of arms 166 and 164 respectively, one opening on each side of lock tab 118. Each of the openings comprises a longitudinal leg opening 130 of U-shaped slot 98 superimposed over a portion of receiver slot 100. Lock tab 118 which is coplanar with back panel 102 of the U of lock channel 80 prevents removal of ring 138 by extending into the ring behind end 168 of the ring. Lock tab 118 is preferably formed by stamping as part of the continuous circumference 128 of the U-shaped slot 98, and separates legs 130.

Lateral ends 174 and 176 of U-shaped slot 98 prevent opening of ring 138 when the ring is locked in the ring capture mechanism by tab 118 in the ring. Lateral ends 174 and 176 intercept parting outward movement of arms 164 and 166 respectively. Lateral ends 174 and 176 have negligible yield to parting force of arms 164 and 166 because ends 174 and 176 resist substantially in tension 178 across the plane of back panel 102 of channel 80. This is an advantage over U channel side walls which are designed to intercept parting outward movement of arms of the ring at the fronts of the walls wherein the walls extend vertically from opposite sides of a plate and can be torqued apart across the walls and the bends which connect them to the plate.

Lateral ends 184 and 188 of slot 100 which has a continuous circumference 192 also intercept parting outward movement of arms 164 and 166 respectively. Lateral ends 184 and 188 have negligeable yield to parting force of arms 164 and 166 because ends 184 and 188 resist substantially in tension 190 across the plane of back panel 79 of receiver channel 78.

Lateral ends 174 and 176 supporting against opening of the ring, and lock tab 118 preventing lifting of a locked-in ring from capture mechanism 70, not extending above the plane of the back panel 102, allow loose-leaf paper 194 mounted on arm 166 very close to panel 102 of lock channel 80, to lie nearly flat across arm 166 and wall 83, as indicated in FIG. 5.

Looseleaf paper 194 lies nearly flat with arm 166 of ring 138, side wall 83 of U-shaped lock channel 80, and with panel 140 of ring binder 72. The lie flat is made available by inner radius 77 of ring 138 passing through back panel 102 below the free side 92 of back panel 102. The free side of back panel 102 is not f acing panel 79 of receiver channel 78, and is facing away from panel 79.

The lie flat feature is provided by U-shaped slot 98 of U-shaped lock channel 80 extending into arcs 75 of the bends of side walls 83 down from back panel 102. The extension of slot 98 through th e attachment of wall 83 to back panel 102 makes it possible for the passage of inner radius 77 through back panel 102 below free side 92. U-shaped slot 98 may also extend through side walls 83 adjacent to back panel 102, thereby further enhancing the lie flat feature whereby inner radius 77 may pass through side walls 83 below back panel 102.

Figure 10:
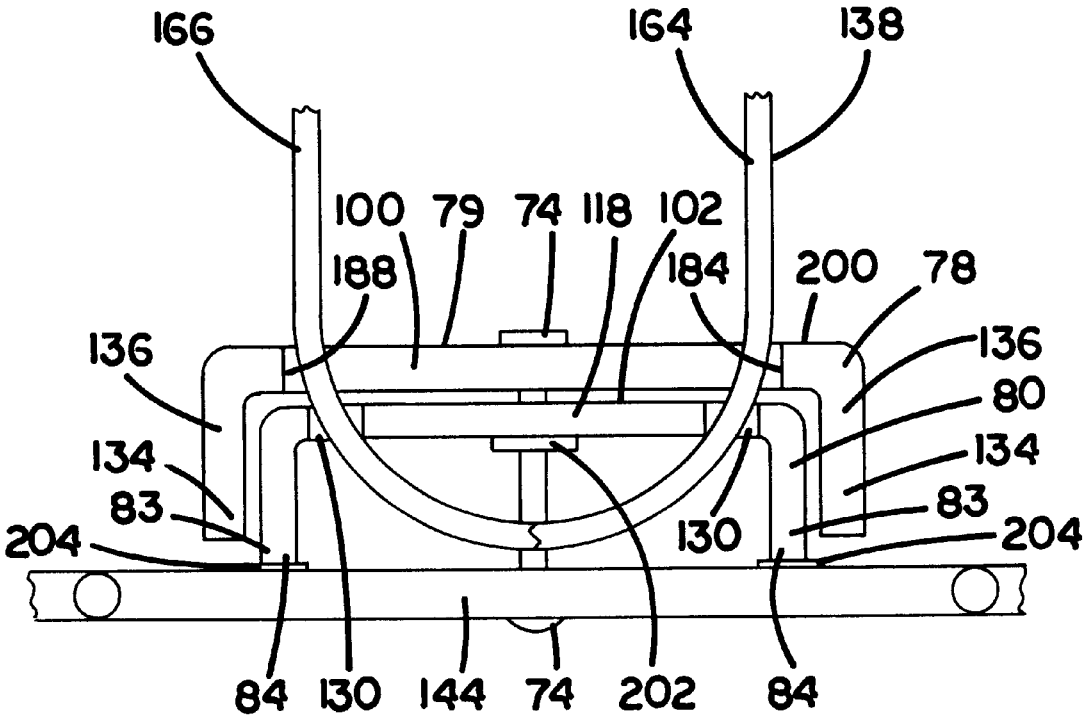
FIG. 10 is a schematic view of a portion of another ring capture mechanism of the invention.

In FIG. 10, ring capture mechanism 200 includes U-shaped receiver channel 78 and U-shaped lock channel 80 described earlier, each sized to fit in the following way.

U-shaped receiver channel 78, has fronts 134 of side walls 136 of the U mounted toward panel 144.

Fastener 74 holds receiver channel 78 fixed with respect to the binder.

U-shaped lock channel 80 which is interposed between channel 78 and panel 144, moves over panel 144. Back panel 102 of the U of channel 80 slides over panel 79 of U-shaped receiver channel 78 parallel to panel 79. It may also be in contact with panel 79. Slide bearing disk 202 on fastener 74 spaces channel 80 from panel 144. Without the slide bearing disk or other means for slidingly supporting channel 80 spaced from panel 144, fronts 84 of sidewalls 83 may be made to slidingly bear against panel 144. A slick surface 204 such as Teflon (tm) tape may be applied to panel 144 to reduce friction.

While the preferred embodiment of the invention has been shown and described, it will be understood that the invention may be embodied otherwise than as herein specifically illustrated or described, and that certain changes in form and arrangement of parts and in the specific manner of practicing the invention may be made without departing from the underlying idea or principles of this invention within the scope of the appended claims.

What I claim is:

1. In a loose-leaf binder construction comprising a pair of arms mounted on a first portion of a cover of the loose-leaf binder, adapted for movement of front ends of said arms toward one another to form a ring for releasably engaging an aperture in a sheet of paper, a second portion of said cover having a length, rotatably connected to said first portion of said cover, and means for releasably holding said ring by the front ends of said arms mounted on said second portion of said cover, the improvement comprising:

said means for releasably holding said ring by the front ends of said arms comprising:

a first U-shaped channel mounted on said second portion of said cover, adapted for moving along said second portion of said cover, comprising a first back panel having a length, a first side wall having a front and a back, a second side wall having a front and a back, said first side wall and said second side wall being attached at their backs to said first back panel forming the U shape with said first back panel, said first U-shaped channel being mounted on said second portion of said cover with the fronts of the first and second sidewalls directed toward said second portion of said cover, a first continuous slot in said first back panel and said first side wall and said second side wall, adapted for receiving said pair of arms within the circumference of said first continuous slot, extending across the middle of said first back panel transverse to the length of the first channel and along a portion of each of said first side and said second side wall forming a tab on said first back panel between said first continuous slot in the side walls.

2. The construction of claim 1, wherein said means for releasably holding said ring by said front ends of said arms further comprises:

a second U-shaped channel mounted fixed on said second portion of said cover, comprising a second back panel, a third side wall having a front and a back, a fourth side wall having a front and a back, said third side wall and said fourth side wall being attached at their backs to said second back panel forming the U shape with said second back panel, said second U-shaped channel being mounted on said second portion of said cover with the fronts of the third and fourth sidewalls directed toward said second portion of said cover, a second continuous slot through said second back panel extending across the middle of said second back panel transverse to the length of the second channel, adapted for receiving said pair of arms within the circumference of said second continuous slot.

3. The construction of claim 2, in which said second continuous slot is aligned with said first continuous slot for receiving said pair of arms within the circumferences of the first and second slots.

4. The construction of claim 2 in which said second back panel is interposed between said first back panel and said second portion of said cover.

5. The construction of claim 4 in which said first back panel is adapted for sliding over said second back panel in a first direction.

6. The construction of claim 4 in which said first U-shaped channel is adapted for moving said first continuous slot into alignment with said second continuous slot for receiving said pair of arms within the circumferences of the first and second slots.

7. The construction of claim 2 which said first back panel is interposed between said second back panel and said second portion of said cover.

8. In a loose-leaf binder construction comprising a pair of arms mounted on a first portion of a cover of the loose-leaf binder, adapted for movement of front ends of said arms toward one another to form a ring for releasably engaging an aperture in a sheet of paper, a second portion of said cover, rotatably connected to said first portion of said cover, and means for releasably holding said ring by the front ends of said arms mounted on said second portion of said cover, the improvement comprising:

said means for releasably holding said ring by the front ends of said arms comprising:

a first U-shaped channel mounted on said second portion of said cover, adapted for moving along said second portion of said cover, comprising a back panel having a length, a first side wall having a front and a back, a second side wall having a front and a back, said first side wall and said second side wall being attached at their backs to said first back panel forming the U shape with said first back panel, said first U-shaped channel being mounted on said second portion of said cover with the fronts of the first and second sidewalls directed toward said second portion of said cover, a first continuous slot in said first back panel, adapted for receiving said pair of arms within the circumference of said first continuous slot, extending across the middle of said first back panel transverse to the length of the first channel forming a tab on said first back panel surrounded on three sides by said first continuous slot .

9. The construction of claim 8, wherein said means for releasably holding said ring by said front ends of said arms further comprises:

a second U-shaped channel mounted fixed on said second portion of said cover, comprising a second back panel, a third side wall having a front and a back, a fourth side wall having a front and a back, said third side wall and said fourth side wall being attached at their backs to said second back panel forming the U shape with said second back panel, said second U-shaped channel being mounted on said second portion of said cover with the fronts of the third and fourth sidewalls directed toward said second portion of said cover, a second continuous slot through said second back panel extending across the middle of said second back panel transverse to the length of the second channel, adapted for receiving said pair of arms within the circumference of said second continuous slot.

10. The construction of claim 9, in which said second continuous slot is aligned with said first continuous slot for receiving said pair of arms within the circumferences of the first and second slots.

11. The construction of claim 9 in which said second back panel is interposed between first back panel and said second portion of said cover.

12. The construction of claim 11 in which said first back panel is adapted for sliding over said second back panel in a first direction.

13. The construction of claim 11 in which said first U-shaped channel is adaoted for moving said first continuous slot into alignment with said second continuous slot for receiving said pair of arms within the circumferences of the first and second slots.

14. The construction of claim 9 in which said first back panel is interposed between said second back panel and said second portion of said cover.

* * * * *